US010048031B1

(12) United States Patent
Milde, Jr.

(10) Patent No.: US 10,048,031 B1
(45) Date of Patent: Aug. 14, 2018

(54) APPARATUS FOR PREVENTING UNSAFE USE OF A GUN

(71) Applicant: Karl F. Milde, Jr., Somers, NY (US)

(72) Inventor: Karl F. Milde, Jr., Somers, NY (US)

( * ) Notice: Subject to any disclaimer, the term of this patent is extended or adjusted under 35 U.S.C. 154(b) by 0 days.

(21) Appl. No.: 15/973,671

(22) Filed: May 8, 2018

Related U.S. Application Data

(63) Continuation-in-part of application No. 15/658,859, filed on Jul. 25, 2017, now Pat. No. 9,989,325.

(51) Int. Cl.
*F41A 17/06* (2006.01)

(52) U.S. Cl.
CPC ..... *F41A 17/063* (2013.01); *F41A 17/066* (2013.01)

(58) Field of Classification Search
CPC ..... F41A 17/066; F41A 17/063; F41A 17/08; F41A 17/30; F41A 17/46; F41A 17/00
USPC ..... 42/70.01, 84, 70.07, 70.06, 66
See application file for complete search history.

(56) References Cited

U.S. PATENT DOCUMENTS 8,955,421 B1 * 2/2015 Kountotsis ..... F41C 27/00 89/1.11
2014/0173959 A1 * 6/2014 Kountotsis ..... F41A 17/063 42/1.02
2014/0173960 A1 * 6/2014 Kountotsis ..... F41A 17/063 42/1.02
2014/0366421 A1 * 12/2014 Arif ..... F41A 17/063 42/70.11

* cited by examiner

*Primary Examiner* — Joshua E Freeman
(74) *Attorney, Agent, or Firm* — Karl F. Milde, Jr.

(57) ABSTRACT

When a person intending to use a gun is a safety risk, the authorities (e.g., the police) should be notified and a gun held by that person should be locked to prevent its firing. Apparatus for doing just that comprises an electronic testing device for determining an emotional state and/or the competency of a person intending to use a gun and for producing a signal when the emotional state and/or competency of the person is not considered appropriate or adequate for a safe and proper use of a gun. An electronic warning device, coupled to said testing device, can be provided to alert the authorities that the person intending to use a gun is at risk of using a gun in an unsafe manner.

15 Claims, 5 Drawing Sheets

APPARATUS FOR PREVENTING UNSAFE USE OF A GUN

CROSS-REFERENCE TO RELATED APPLICATIONS

This application is a continuation-in-part of, and claims priority from, the U.S. patent application Ser. No. 15/658,859, filed Jul. 25, 2017, entitled "SECURE SMARTPHONE-OPERATED GUN LOCK WITH MEANS FOR OVERRIDING RELEASE OF THE LOCK" (now allowed); which application was a division of the U.S. patent application Ser. No. 15/472,469, filed Mar. 29, 2017, entitled "SECURE SMARTPHONE-OPERATED GUN LOCK WITH MEANS FOR OVERRIDING RELEASE OF THE LOCK" (now U.S. Pat. No. 9,746,265) and the U.S. patent application Ser. No. 15/063,665, filed Mar. 8, 2016, entitled "SECURE SMARTPHONE-OPERATED GUN LOCK WITH MEANS FOR OVERRIDING RELEASE OF THE LOCK" (now U.S. Pat. No. 9,644,912); which applications, in turn, were divisions of the U.S. patent application Ser. No. 14/513,344, filed Oct. 14, 2014 (now U.S. Pat. No. 9,316,454). The present application also claims priority from the U.S. patent application Ser. No. 15/432,140, filed Feb. 14, 2017, entitled "SECURE SMARTPHONE-OPERATED GUN LOCK WITH MEANS FOR OVERRIDING RELEASE OF THE LOCK."

In summary and in addition, the present application claims priority from the following U.S. patent applications:

(1) Provisional Application No. 61/761,270, filed Feb. 6, 2013, entitled "SECURE SMARTPHONE-OPERATED GUN TRIGGER LOCK;"

(2) patent application Ser. No. 13/763,951, filed Feb. 11, 2013, entitled "SECURE SMARTPHONE-OPERATED GUN TRIGGER LOCK" (now U.S. Pat. No. 8,893,420);

(3) Provisional Application No. 61/841,559, filed Jul. 1, 2013, entitled "SECURE SMARTPHONE-OPERATED GUN LOCK";

(4) patent application Ser. No. 14/017,666 filed Sep. 4, 2013, entitled "SECURE SMARTPHONE-OPERATED GUN TRIGGER LOCK" (now U.S. Pat. No. 8,919,024);

(5) patent application Ser. No. 14/140,658, filed Dec. 26, 2013, entitled "SECURE SMARTPHONE-OPERATED GUN LOCK WITH MEANS FOR OVERRIDING RELEASE OF THE LOCK" (now U.S. Pat. No. 8,931,195);

(6) patent application Ser. No. 14/513,344, filed Oct. 14, 2014, and entitled "SECURE SMARTPHONE-OPERATED GUN LOCK WITH MEANS FOR OVERRIDING RELEASE OF THE LOCK" (now U.S. Pat. No. 9,316,454);

(7) patent application Ser. No. 14/562,854, filed Dec. 8, 2014, entitled "SECURE SMARTPHONE-OPERATED GUN LOCK WITH MEANS FOR OVERRIDING RELEASE OF THE LOCK" (now U.S. Pat. No. 9,303,935);

(8) patent application Ser. No. 15/050,643, filed Feb. 23, 2016, entitled "SECURE SMARTPHONE-OPERATED GUN LOCK WITH MEANS FOR OVERRIDING RELEASE OF THE LOCK" (now U.S. Pat. No. 9,551,543);

(9) patent application Ser. No. 15/063,665, filed Mar. 8, 2016, entitled "SECURE SMARTPHONE-OPERATED GUN LOCK WITH MEANS FOR OVERRIDING RELEASE OF THE LOCK" (now U.S. Pat. No. 9,644,912);

(10) patent application Ser. No. 15/432,140, filed Feb. 14, 2017, entitled "SECURE SMARTPHONE-OPERATED GUN LOCK WITH MEANS FOR OVERRIDING RELEASE OF THE LOCK" (now U.S. Pat. No. 9,803,942);

(11) patent application Ser. No. 15/472,469, filed Mar. 29, 2017, entitled "SECURE SMARTPHONE-OPERATED GUN LOCK WITH MEANS FOR OVERRIDING RELEASE OF THE LOCK" (now U.S. Pat. No. 9,746,265);

(12) patent application Ser. No. 15/658,859, filed Jul. 25, 2017, entitled "SECURE SMARTPHONE-OPERATED GUN LOCK WITH MEANS FOR OVERRIDING RELEASE OF THE LOCK" (allowed); and

(13) patent application Ser. No. 15/728,741, filed Oct. 10, 2017, entitled "SECURE SMARTPHONE-OPERATED GUN LOCK WITH APPARATUS FOR PREVENTING FIRING IN PROTECTED DIRECTIONS."

To the fullest extent permitted by law, the disclosures of these patent applications and patents are incorporated herein by reference.

BACKGROUND OF THE INVENTION

The present invention relates to a gun lock for a hand gun, such as a pistol or rifle, to prevent the owner or any other person who is authorized to use the gun from firing the gun at times when it is inappropriate or dangerous to do so.

Mechanical gun padlocks are designed to be installed on the guns in a position behind the trigger to block the trigger from moving rearward and firing the gun. Mechanical gun locks have also been installed within guns to prevent movement of the firing pin or other parts of the firing mechanism unless disabled with a key. Such gun locks use a physical key that can be easily duplicated, and the locks themselves can be compromised by means of a master key or a lock pick. These gun locks can therefore be opened by anyone in possession of one of the keys. With such gun locks it is not possible to restrict the use of the gun to the gun owner or to some other person who is licensed or otherwise authorized to use the gun.

The aforementioned U.S. patent application Ser. No. 13/763,951, filed Feb. 11, 2013 discloses a gun lock system which uses a "smartphone," such as an Apple "iPhone," with a suitable application ("phone app") as an electronic key to unlock the gun. The smartphone transmits biologic identification ("BioID") data about a person to an electronic lock on the gun which, in turn, matches it with pre-stored data and unlocks the gun if a proper match is found. This system allows only the gun owner (or some other person who is licensed or otherwise authorized), who has originally supplied their BioID data to the gun lock for storage, to use the gun. The system is difficult to compromise and yet allows the gun to be unlocked by any smartphone that can collect BioID data and transmit it to the gun. This system avoids the problem of unlocking a gun when the user's smartphone has been lost, stolen or broken or has been replaced by a new one.

Unfortunately, even the owner of a gun, or another person otherwise properly authorized to use the gun, may have the intention, as an act of anger, revenge, hostility, mental illness or the like, to use the gun inappropriately and thereby cause bodily harm or death to another human being. In such instances, it would be desirable to somehow anticipate the incompetency or inability of such a person to use the gun properly and safely, and either to alert the authorities or to lock the gun, or both, and thereby prevent its inappropriate use.

Moreover, it would be desirable to prevent the firing of a gun, even by the owner or another person otherwise properly authorized to use the gun, when such owner or authorized person is under the influence of drugs or alcohol, or is otherwise acting in less than a sane and sober manner.

It would also be desirable to prevent the firing of a gun in situations where the owner, or another person otherwise properly authorized to use the gun, has not planned in advance to make use of the gun. In this way, it may be possible to avoid unpremeditated uses of the gun that may occur in the so-called "heat of passion."

Finally, it would be desirable to override all of the aforementioned safety precautions in the case of imminent danger to a person in possession of a gun, where immediate use of the gun is necessary, such as when a hostile third party threatens bodily injury or even death.

SUMMARY OF THE INVENTION

An object of this invention, therefore, is to provide an "expert system" built into a smartphone, or into a gun, which will alert the authorities or lock the gun, or both, when a person, whether authorized to use the gun or not, may attempt or does attempt to fire the gun inappropriately.

This object, as well as other objects which will become apparent from the discussion that follows, is achieved, in accordance with a first preferred embodiment of the present invention, by providing apparatus for locking a gun to prevent its use, which comprises:

(1) a testing device for determining a level of competency of a person intending to use a gun and producing a first signal representing the level of competency;

(2) a mechanical locking member associated with a gun and movable between a locked position which prevents the gun from firing and an unlocked position which enables the gun to be fired;

(3) a first logic device, coupled to receive the first signal, for producing a second signal indicative that the level of competency of the person is below a prescribed level; and (4) an electromechanical actuator, mechanically coupled to the locking member and electronically coupled to the first logic device, for a least one of (1) moving the member from the unlocked position to the locked position and (2) holding the member in the locked position in response to the second signal.

According to the invention, the testing device is built into a smartphone used by the person intending to use a gun, which comprises an app for monitoring communications of the smartphone user and for interpreting these communications to determine the level of competency of the person to use a gun safely.

The apparatus is thereby operative to maintain the locking member in a locked position and thereby to prevent the gun from firing when the level of competency of the person intending to use the gun is inadequate for safe use of the gun.

The communications of the smartphone user include not only emails, texts, etc. sent by the user to a third party, but also communications of the user to himself/herself, such as memos, a diary, etc.

In a particularly advantageous embodiment of the invention, the smartphone includes a data transmitter for transmitting the first signal and he apparatus further comprises a data receiver located on the gun for receiving the first signal from the smartphone.

In this embodiment the apparatus preferably further comprises:

(5) a second logic device, coupled to the electromechanical actuator and to the data receiver, for receiving gun control signals from the smartphone and transmitting lock and unlock signals to the actuator in response thereto;

(6) a data memory coupled to the second logic device for storing gun unlock data representing first personal information about a person authorized to use the gun; and (7) a gun key device for unlocking the gun, the gun key device including the smartphone and comprising:

(a) a data transmitter for transmitting gun control signals to the data receiver;

(b) a first input device for inputting second personal information about a putative authorized person who wishes to unlock the gun; and (c) the first logic device, coupled to each of the data transmitter, the input device and the testing device, including a phone app with instructions for generating the gun control signals from the second personal information and from the first signal for transmission to the data receiver. In this case, the first logic device is operative to cause the gun lock device to enable the gun to be fired when the second personal information received by the data receiver are substantially the same as the first personal information stored in the data memory and to cause the gun lock device to prevent the gun from being fired when the level of competency of the putative authorized person is inadequate for safe use of the gun.

Advantageously, the second gun unlock data stored in the data memory represent biologic identifying information of a person authorized to use the gun.

This biologic identifying information preferably includes a bodily aspect of the authorized person, selected from the group consisting of:

a facial image;
an image of an iris;
a retinal image;
a fingerprint;
a palm print; and
an image of veins of a hand; and wherein the second logic device is operative to process the image and to generate the gun unlock data therefrom.

Advantageously, in this embodiment, once the second signal is produced by the logic device, this signal is preferably maintained for a prescribed period of time after the person's level of competency has fallen below the prescribed level, to ensure against "relapse" of the person below the level of competency that is considered safe for a person's use of a gun.

In accordance with a second preferred embodiment of the present invention, apparatus is provided for preventing a gun from firing under certain circumstances which comprises:

(1) a testing device for determining a level of competency of a person intending to use a gun and producing a first signal representing the level of competency;

(2) a mechanical locking member associated with a gun and movable between a locked position which prevents the gun from firing and an unlocked position which enables the gun to be fired;

(3) a first logic device, coupled to receive the first signal, for producing a second signal indicative that the level of competency is below a prescribed level; and (4) an electromechanical actuator, mechanically coupled to the locking member and electronically coupled to the first logic device, for a least one of (1) moving the member from the unlocked position to the locked position and (2) holding the member in the locked position in response to the second signal.

According to the invention the testing device comprises a smartphone, used by the person intending to use a gun, having an app for monitoring social media entries posts of this person and for interpreting these entries and posts to thereby determine the level of competency of the person to use a gun safely.

The apparatus is thereby operative to maintain the locking member in a locked position and thereby to prevent the gun from firing when the level of competency of the person intending to use the gun is inadequate for safe use of the gun.

As used herein, the term "social media" is intended to mean and include forms of electronic communication that enable users to create and share content or to participate in social networking. Typical of these are websites and applications dedicated to forums, microblogging, social networking, social bookmarking, social curation and wikis.

As in the case with the first preferred embodiment, smartphone preferably further includes a data transmitter for transmitting the first signal and the apparatus further comprises a data receiver located on the gun for receiving the first signal from the smartphone.

In this embodiment, the apparatus may further comprise:

(5) a second logic device, coupled to the electromechanical actuator and to the data receiver, for receiving gun control signals from the smartphone and transmitting lock and unlock signals to the actuator in response thereto;

(6) a data memory coupled to the second logic device for storing gun unlock data representing first personal information about a person authorized to use the gun; and (7) a gun key device for unlocking the gun, the gun key device including the smartphone and comprising:

(a) a data transmitter for transmitting gun control signals to the data receiver;

(b) a first input device for inputting second personal information about a putative authorized person who wishes to unlock the gun; and (c) the first logic device, coupled to each of the data transmitter, and the input device and the testing device, including a phone app with instructions for generating the gun control signals from the second personal information and from the first signal for transmission to the data receiver.

According to the invention, the first logic device is operative to cause the gun lock device to enable the gun to be fired when the second personal information received by the data receiver are substantially the same as the first personal information stored in the data memory and to cause the gun lock device to prevent the gun from being fired when the level of competency of the putative authorized person is inadequate for safe use of the gun.

Advantageously, the second gun unlock data stored in the data memory represent biologic identifying information of a person authorized to use the gun.

This biologic identifying information preferably includes a bodily aspect of the authorized person, selected from the group consisting of:

a facial image;

an image of an iris;

a retinal image;

a fingerprint;

a palm print; and an image of veins of a hand; and wherein the second logic device is operative to process the image and to generate the gun unlock data therefrom.

Once the second signal is produced, the logic device preferably maintains the second signal for a prescribed period of time after the person's level of competency has fallen below the prescribed level.

Instead of locking and maintaining the gun in the locked state, or in addition thereto, apparatus according to the invention can alert the authorities, for example the police, that a person intending to use a gun is a safety risk. Accordingly, in a third preferred embodiment of the invention, the apparatus comprises:

(1) an electronic testing device for determining an emotional state of a person intending to use a gun and producing a signal indicative that the level of competency of the person is below a prescribed level considered adequate for a safe and proper use of a gun; and (2) an electronic warning device, coupled to the testing device, for alerting the authorities that the person intending to use a gun is at risk of using a gun in an unsafe manner.

In this embodiment too, the testing device comprises a smartphone, used by the person intending to use a gun, that includes an app for monitoring communications sent from the smartphone, and for interpreting the communications, to thereby determine the level of competency of the person to use a gun safely. The apparatus is thus operative to alert the authorities who can act to prevent the person from firing a gun when the level of competency of the person is considered inadequate for a safe and proper use of a gun.

Alternatively, the testing device comprises a smartphone, in use by the person intending to use a gun, that has an app for monitoring social media of the person intending to use a gun and for interpreting entries in the social media made by the person to thereby determine the level of competency of the person to use a gun safely; In this way, the apparatus is operative to alert the authorities, who can act to prevent the person from firing a gun, when the level of competency of the person is considered inadequate for a safe and proper use of a gun.

Finally, a fourth preferred embodiment of the present invention includes apparatus for alerting authorities when it is determined that a person intending to use a gun is a safety risk. In this case, the apparatus comprises:

(1) an electronic testing device for determining an emotional state of a person intending to use a gun and producing a signal indicative that the emotional state of the person is not considered appropriate for a safe and proper use of a gun; and (2) an electronic warning device, coupled to the testing device, for alerting the authorities that the person intending to use a gun is at risk of using a gun in an unsafe manner According to the invention, the testing device comprises:

(a) a wideband wireless transmitter and receiver for transmitting a wireless signal and capturing reflection signals;

(b) a first logic device, coupled to the receiver for (i) isolating the reflection signals received from different signal-reflecting objects and (ii) determining phase variations of the reflection signals received from an isolated, signal-reflecting person due to breathing and heartbeats of the person; and (c) a second logic device, coupled to the first logic device for determining the emotional state of the person based upon the breathing and heartbeats of the person.

The apparatus is thereby operative to alert the authorities, who can act to prevent the person from firing a gun, when the emotional state of the person is not considered appropriate for a safe and proper use of a gun.

A system for passively monitoring a person's breathing and heart rate is known in the art and has been called "Vital-Radio" because it uses wireless signals to detect a person's vital signs.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
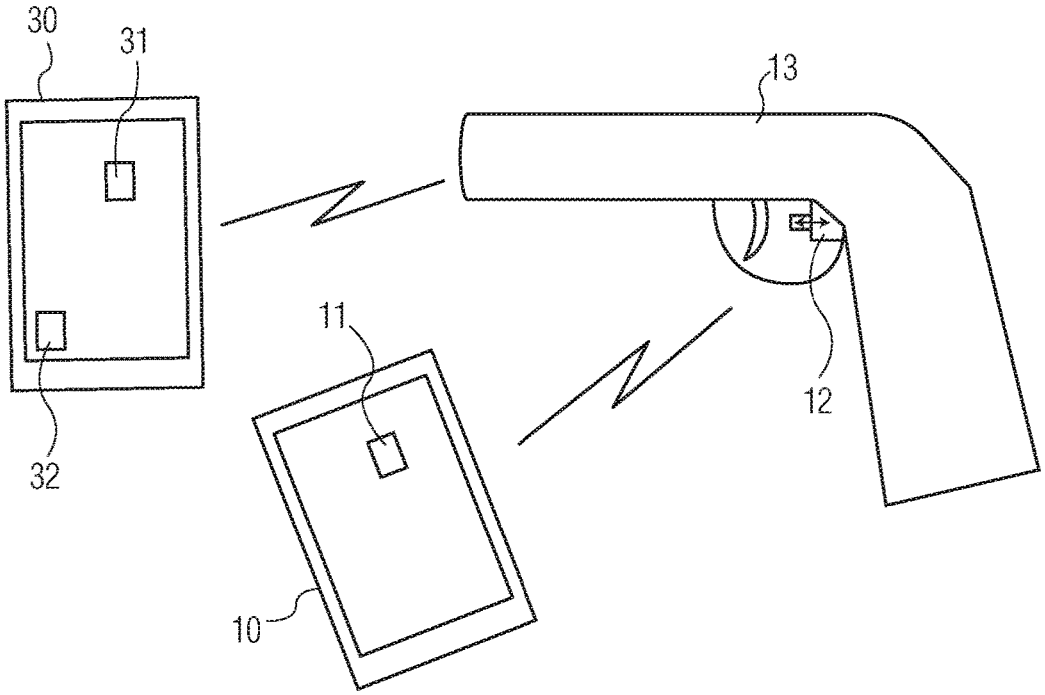
FIG. 1 is a representational diagram showing a smartphone and a gun that is equipped with a gun lock according to the present invention.

The preferred embodiments of the present invention will now be described with reference to FIGS. 1-6 of the drawings. Identical elements in the various figures are identified with the same reference numerals.

Briefly in overview, a battery-operated gun-locking device is permanently attached to, or installed on and incorporated into a gun. For example a trigger lock may be installed in a recess behind the trigger or in the lower receiver mechanism of the gun. In its default condition, a movable member is in a forward position, blocking rearward movement of the trigger. When unlocked, the movable member is drawn rearward to allow movement of the trigger.

The gun-locking device has a Bluetooth or other type of wireless receiver and a memory with stored security data. When data matching this stored data is received from a smartphone or similar device, the gun-locking device enables the gun to fire. Otherwise the gun is locked against firing.

FIG. 1 illustrates this configuration. A smartphone 10 has an app that presents a screen button 11 called "Gun Lock" for each gun the smartphone owner owns or is licensed to use. By pressing this button on the app, the owner sends a password, a pseudo-random number or biologic ID security data by a Bluetooth wireless connection to a locking and unlocking device 12 installed permanently in a gun 13.

The smartphone 10 has a microphone which is used for voice communication. This microphone can be used to unlock the gun in an emergency situation when the owner feels threatened. By speaking a "secret word" or phrase known only to the owner of the gun, the owner can override and bypass the gun security features provided by the gun lock app. This is effected by detecting the word or phrase, either by an algorithm in the smartphone 10 or in the gun trigger lock itself, by transmission via Bluetooth, and once detected, unlocking the trigger lock.

One or more additional smartphones 30 have an app that presents a screen button 31 called "Gun Lock" that may be used to lock and/or unlock a particular gun (using the password, a pseudo-random number or biologic ID security data) or, as a master key, to lock all guns in the vicinity of the Bluetooth connection. Like the smartphone 10, this smartphone 30 may have a GPS locater 32 that causes the app to automatically send out a signal to lock the gun(s) whenever the smartphone 30 senses that the gun 13, or any other gun, is within its Bluetooth connection area. In this way, the gun 13 (and/or any other gun) may be locked against firing when in the vicinity of a school or any other area where the firing of guns is prohibited.

Alternatively or in addition, the GPS locater may be disposed on the gun itself to automatically lock the gun: (1) when it is within a prescribed geographical area or (2) when it is within a prescribed distance from a certain person who is protected by a court order against possible violence by the gun owner or user. In the latter case, the protected person carries the smartphone 30 with the GPS locater. The logic device within the gun lock compares the GPS location of the gun with the GPS location of the smartphone 30, transmitted to the gun for example by Bluetooth, and causes the gun lock 12 to operate to prevent the gun from firing when the two locations are within a prescribed distance from each other.

Figure 2:
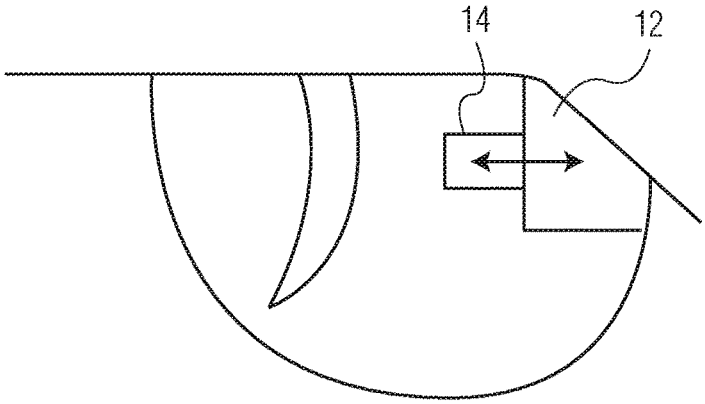
FIG. 2 is a close-up view of the trigger region of the gun of FIG. 1 with the gun lock installed.

FIG. 2 shows a trigger-locking device 12 with a movable member 14, which may be used as a gun locking device. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security App may use face recognition or iris recognition software to identify the owner from the camera image.

When the gun locking device 12 is first used, the smartphone app can generate a pseudo-random number and send it to the gun locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the gun locking device releases the lock so the gun may be fired. Before sending the unlock number, the user of the smartphone may be required to identify himself/herself by entering biologic identifying information into the phone for a recognition algorithm. Alternatively, the biologic ID information may be sent to the gun locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identity with the smartphone; and (2) Press the Gun Unlock button to enable the gun lock to be released.

The gun remains unlocked until the gun user presses another button on the smartphone app, appropriately called "Gun Lock," or until the gun lock times out and automatically locks itself by restoring the gun lock to the locked position.

The gun locking device 12 is preferably powered by a replaceable and/or rechargeable battery (not shown).

Figure 3:
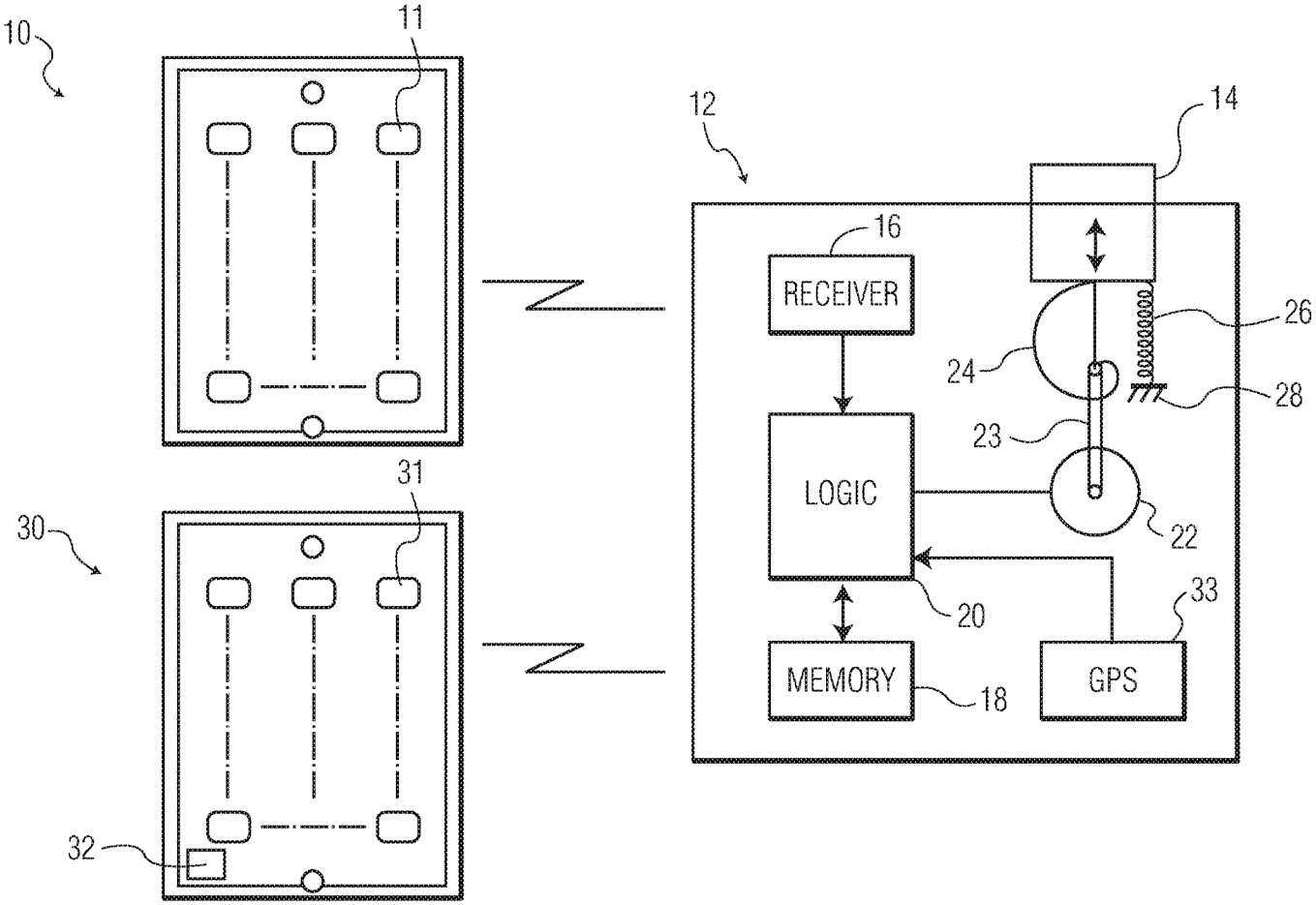
FIG. 3 is a block diagram showing a first preferred embodiment of the gun lock according to the present invention.

FIG. 3 shows the individual elements of the gun lock apparatus. The smartphone 10 transmits to a receiver 16 in the gun locking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone 10 is indeed the owner of the gun. Once the right to use the gun has been established, the user of the smartphone 10 can unlock (and, if desired, also lock) the gun.

Similarly, the second smartphone 30 may send a signal to the gun locking device to either to lock or unlock the gun. This smartphone 30 may also be used as a master key, by police for example, and transmit a data packet that matches data stored in all guns and can therefore control (lock and unlock) all guns.

The smartphone 30 may also have a GPS locater 32 and responsive software which automatically sends out a gun locking signal whenever the Bluetooth connection has been established with a particular gun (matched by the security data) or with all guns in the vicinity (by master key operation as explained above).

According to another embodiment of the invention, the gun locking device itself may include a GPS locater and software that runs in the logic device 20, which automatically causes the gun to lock when it is brought into a proscribed geographical area, such as within a school or other public building or without an airport or shopping mall.

According to another embodiment of the invention, the smartphone 10 may be configured to be attachable to, or may be permanently incorporated into, the gun 13, for example on or in the handle grip.

Figure 4:
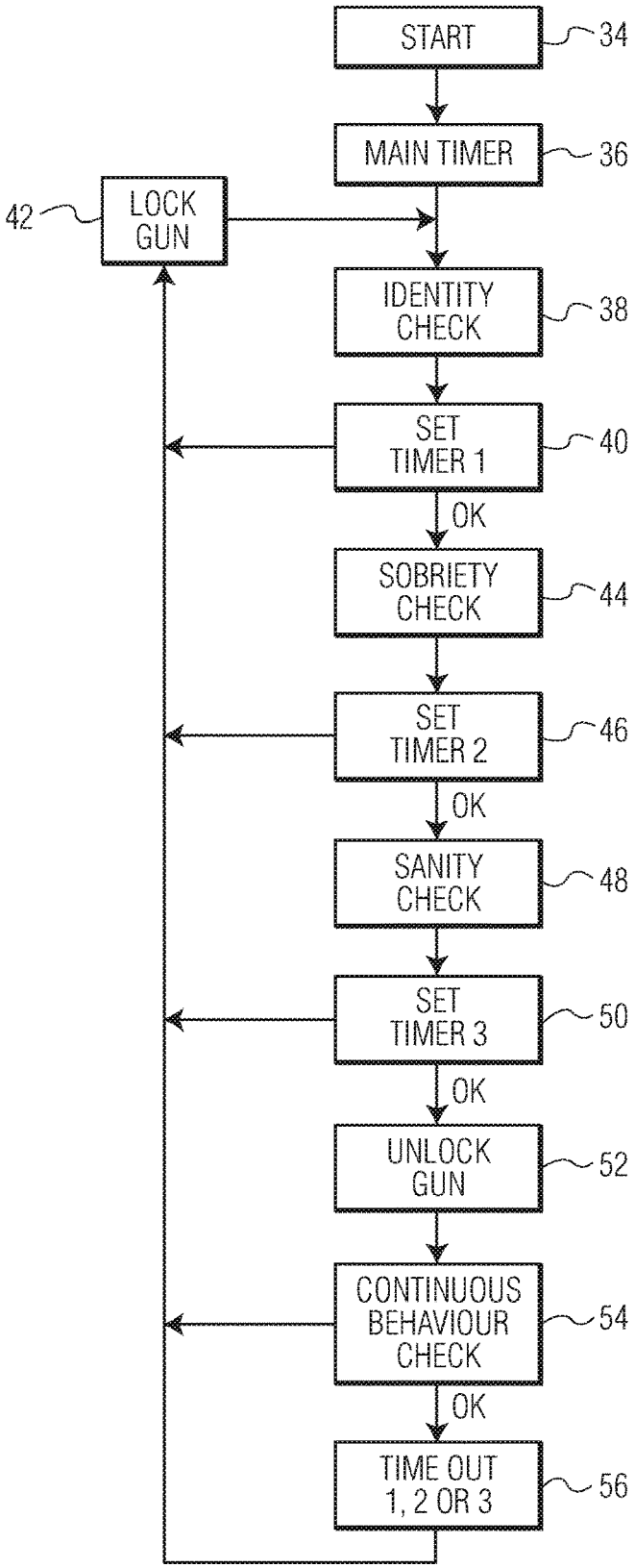
FIG. 4 is a flow chart showing the operation of a smartphone application ("App") according to a second preferred embodiment of the present invention.

FIG. 4 is a flow chart of an algorithm for the app that may be used with the smartphone 10 to ensure that the owner, or any other person who is authorized to use the gun, can use the gun only when it is proper to do so.

When the owner or other authorized person wishes to use the gun, he/she must plan ahead. After the button 11 for gun lock app is initially pressed on the smartphone 10 the algorithm starts at 34 and immediately sets a main timer 36. Only after this timer times out (for example, after an hour, several hours or even a day) does the app allow the gun to be used at all. This initial period prevents the gun from being used except when the owner or authorized person has planned to do so in advance. The smartphone 10 could be programmed to register, and possibly obtain clearance for, the use of the gun with a third party, such as the police, by automatically placing a phone call to the third party during this "blackout period."

Upon the expiration of the time period set in the main timer 36, the app carries out an identity check 38 of the gun user by bio-identification using a camera (e.g. for face, fingerprint or iris recognition), or a microphone (for voice ID). Following this identity check, a first timer 38 is set. If gun owner or other authorized person is not properly identified, the app transfers control to the gun lock 42 which maintains gun in the locked state until the first timer 38 times out. If the gun user is properly identified the app carries out a sobriety check 44, for example by means of a breathalyzer unit plugged into the smartphone 10, and sets a second timer 46. Depending upon the level of intoxication (if any) detected by the breathalyzer, the timer can be set to expire at a time when the user is expected to again reach sobriety. Assuming the user passes the sobriety check, the app conducts a sanity check 48, for example by requiring the user to answer a number of oral or written questions to determine whether the user is acting rationally. The app then sets a third timer 50 before continuing. Assuming the smartphone user answers the questions appropriately and is otherwise authorized or licensed to use the gun, the smartphone unlocks the gun at 52. During use of the gun, the app can continue to monitor the user's behavior at 54 and cause the gun to be locked if inappropriate or irrational behavior is detected. Such behavior may include, for example, angry, inappropriate or irrational comments heard by the smartphone microphone. Finally, if any one of the first, second or third timers times out at 56 the app again causes the gun to be locked at 42.

Figure 5:
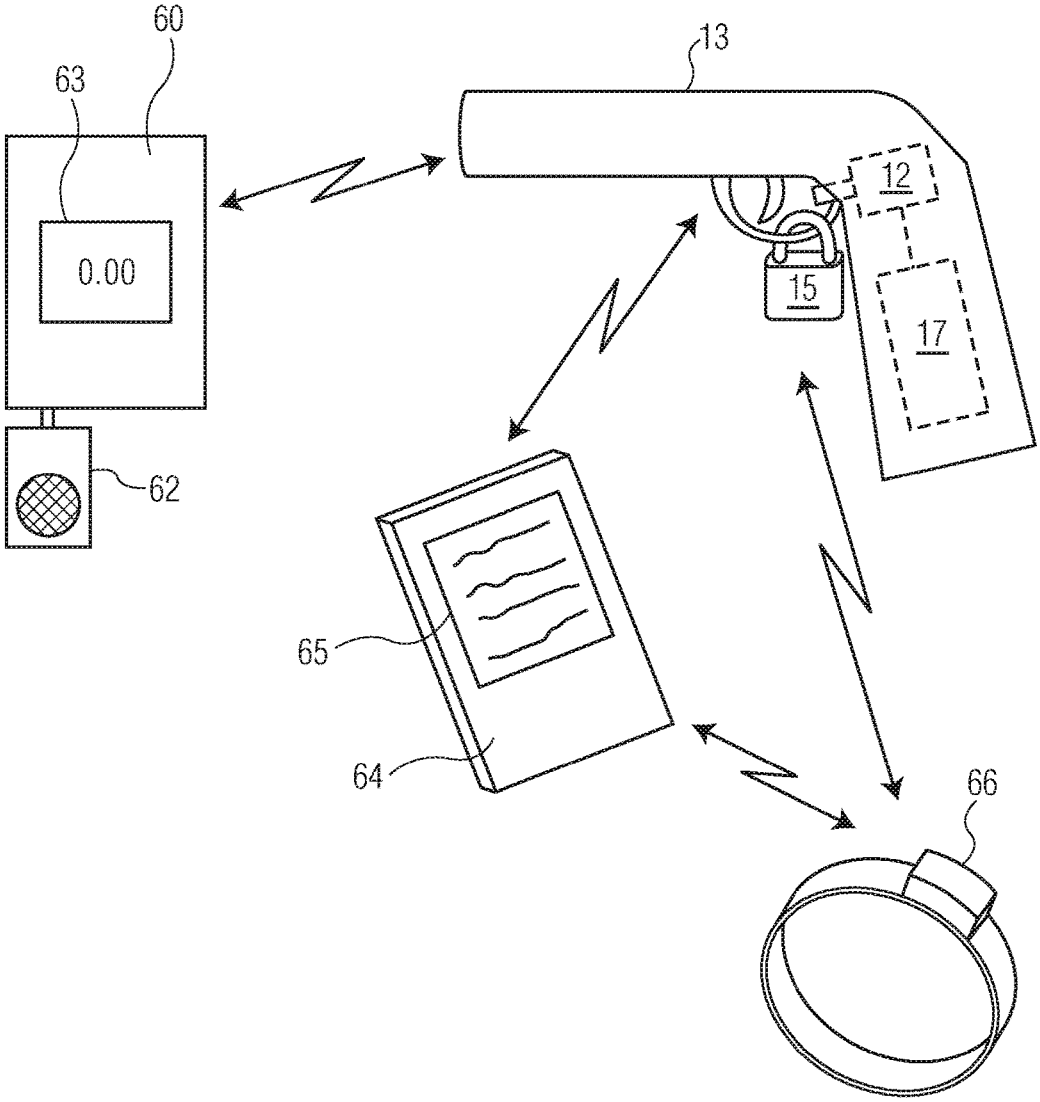
FIG. 5 is a block diagram showing an exemplary embodiment of the apparatus, according to the invention, which includes two Apple iPhones and an Apple watch.

FIG. 5 shows a handgun 13 having an internal mechanical gun lock 12 with a movable member 14 controlled by a battery-operated electronic device 17 built into the gun handle. The gun lock can also take the form of a padlock 15 which is installed manually by the user and incorporates the same mechanical and electrical elements as the gun lock 12.

The gun locks 12 or 15 are controlled by smartphones 60 and 64, such as the Apple iPhones shown, as well as by a smart watch 66, such as the Apple watch.

In this embodiment, a breathalyzer device 62 is plugged into the earphone jack of the smartphone 60. The smartphone 60 receives an electronic signal representing the level of intoxication and displays this level on its screen 63.

The smartphone 64 receives medical data, such as blood pressure, blood oxygen level and/or the sweat and/or temperature of a body part, from the smart watch 66 and displays this data on its screen 65. The smartphone analyzes the medical data and transmits an unlock signal to the gun only if the person wishing to unlock the gun exhibits an appropriate level of sobriety, competency and calmness of demeanor. The smartphone 64 can also actively query the gun user who must respond appropriately for the smartphone to unlock the gun.

Figure 6:
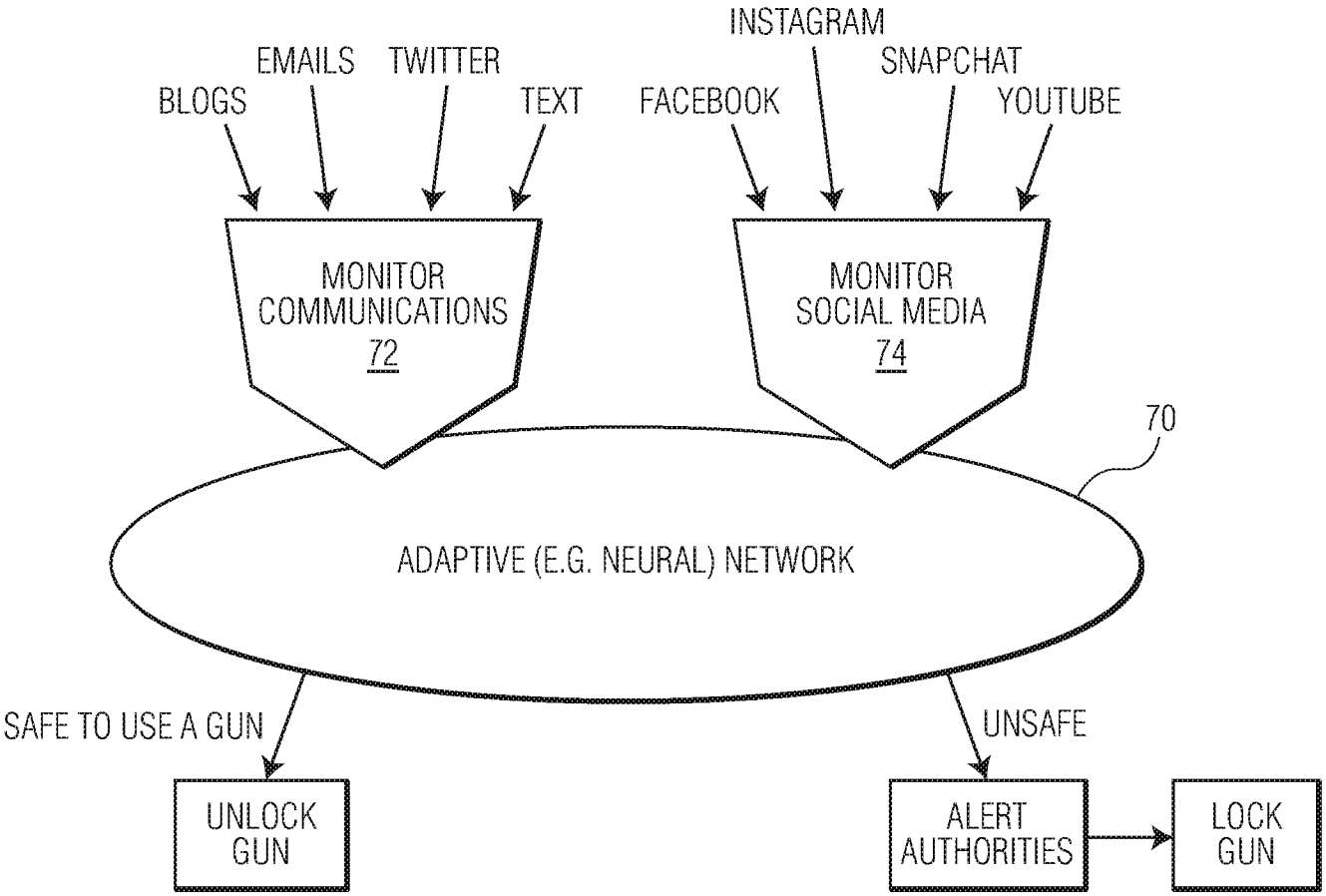
FIG. 6 is a representational diagram illustrating the decision-making process of the "expert system" according to the invention.

FIG. 6 illustrates the process, according to a preferred embodiment of the present invention, for determining whether a person who intends to use a gun is competent and in the proper frame of mind to use the gun wisely, properly and safely. The entire algorithm can be contained in a smartphone app, or it can be carried out, in part, by an expert system in an online server which assists the app in performing the several functions and operations.

The algorithm shown in FIG. 6 has been divided into two parts for convenience in understanding, although in practice these parts may be merged into a single expert system. The system comprises an adaptive network 70, such as a neural network, that learns by doing and by continuously receiving "updates" which result from knowledge gained by the experience of other persons who use a similar app for similar purposes (determining whether it is safe for a person to use a gun). The adaptive network receives inputs from monitoring the person's communications 72 and monitoring the person's social media 74. The communications sent by the person who uses the smartphone may include, for example, the person's blogs, emails, twitter messages and text messages. The social media of the person who uses the smartphone may include for example that person's posts on Facebook, Instagram, SnapChat and YouTube.

The smartphone app 72, 74 monitors these communications, messages and posts for keywords, phrases and information that indicate the persons state of mind. The smartphone app can be assisted by a remote server in monitoring this "chatter" and can, for example, use methods similar to known methods used by the authorities (e.g., the Federal Bureau of Investigation) in monitoring communications for terrorist activity.

The results obtained from this active monitoring are analyzed by an adaptive network 70, which may be of the type used by credit card agencies to monitor the activity for fraudulent transactions. A determination is made, minute by minute and second by second, as to whether the smartphone user is competent to use a gun properly and safely. If the person's level of competency falls below a threshold which is considered necessary and/or desirable for the safe use of a gun, the smartphone automatically alerts the authorities, for example by calling or sending a text message to the police. If the smartphone has been electronically paired with a gun, by Bluetooth or otherwise, and can issue a command to the gun, the app will automatically lock the gun when the level of competency is inadequate for safe and proper use of the gun.

In a particular, preferred embodiment of the present invention, the smartphone app may take advantage of a system called "Vital-Radio" which remotely and passively monitors the breathing and heart rate of a person intending to use a gun. This technique is explained in the article "Smart Homes that Monitor Breathing and Heart Rate," by Fadel Adib, et al. which is incorporated herein by reference. From a person's breathing and heart rate it is possible to determine wither the person is angry or sad. See "Detecting Emotions with Wireless Signals" by Adam Conner-Simons and Rachel Gordon.

There has thus been shown and described a novel apparatus for preventing the unsafe use of a gun which fulfills all the objects and advantages sought therefor. Many changes, variations and other uses and applications of the subject invention will become apparent to those skilled in the art after considering this specification and the accompanying drawings. All such changes, variations and other uses and applications which do not depart from the spirit and scope of the invention are deemed to be covered by the claims that follow.

What is claimed is:

1. Apparatus for preventing a gun from firing under certain circumstances, the apparatus comprising, in combination:

(1) a testing device for determining a level of competency of a person intending to use a gun and producing a first signal representing said level of competency;

(2) a mechanical locking member associated with a gun and movable between a locked position which prevents the gun from firing and an unlocked position which enables the gun to be fired;

(3) a first logic device, coupled to receive said first signal, for producing a second signal indicative that the level of competency of the person is below a prescribed level; and (4) an electromechanical actuator, mechanically coupled to the locking member and electronically coupled to said first logic device, for a least one of (1) moving said member from the unlocked position to the locked position and (2) holding said member in the locked position in response to the second signal;

wherein said testing device comprises a smartphone used by said person intending to use a gun, said smartphone comprising an app for monitoring communications of the smartphone user and for interpreting said communications to thereby determine the level of competency of said person to use a gun safely;

whereby the apparatus is operative to maintain the locking member in a locked position and thereby to prevent the gun from firing when the level of competency of said person intending to use the gun is inadequate for safe use of the gun.

2. The apparatus defined in claim 1, wherein said smartphone includes a data transmitter for transmitting said first signal and wherein said apparatus further comprises a data receiver located on the gun for receiving said first signal from said smartphone.

3. The apparatus defined in claim 2, further comprising:

(5) a second logic device, coupled to said electromechanical actuator and to said data receiver, for receiving gun control signals from said smartphone and transmitting lock and unlock signals to said actuator in response thereto;

(6) a data memory coupled to said second logic device for storing gun unlock data representing first personal information about a person authorized to use the gun; and (7) a gun key device for unlocking the gun, said gun key device including said smartphone and comprising:

(a) a data transmitter for transmitting gun control signals to said data receiver;

(b) a first input device for inputting second personal information about a putative authorized person who wishes to unlock the gun; and (c) said first logic device, coupled to each of said data transmitter, said input device and said testing device, including a phone app with instructions for generating said gun control signals from said second personal information and from said first signal for transmission to said data receiver;

wherein said first logic device is operative to cause said gun lock device to enable the gun to be fired when the second personal information received by said data receiver are substantially the same as the first personal information stored in said data memory and to cause said gun lock device to prevent the gun from being fired when the level of competency of the putative authorized person is inadequate for safe use of the gun.

4. The apparatus defined in claim 3, wherein said second gun unlock data stored in said data memory represent biologic identifying information of a person authorized to use the gun.

5. The apparatus defined in claim 4, wherein said biologic identifying information includes a bodily aspect of said authorized person, selected from the group consisting of:

a facial image;

an image of an iris;

a retinal image;

a fingerprint;

a palm print; and an image of veins of a hand; and wherein said second logic device is operative to process said image and to generate said gun unlock data therefrom.

6. Apparatus for preventing a gun from firing under certain circumstances, said apparatus comprising, in combination:

(1) a testing device for determining a level of competency of a person intending to use a gun and producing a first signal representing said level of competency;

(2) a mechanical locking member associated with a gun and movable between a locked position which prevents the gun from firing and an unlocked position which enables the gun to be fired;

(3) a first logic device, coupled to receive the first signal, for producing a second signal indicative that the level of competency is below a prescribed level; and (4) an electromechanical actuator, mechanically coupled to the locking member and electronically coupled to said first logic device, for a least one of (1) moving said member from the unlocked position to the locked position and (2) holding said member in the locked position in response to the second signal;

wherein said testing device comprises a smartphone, in use by said person intending to use a gun, said smartphone having an app for monitoring social media of said person intending to use a gun and for interpreting entries in said social media made by said person to thereby determine said level of competency of said person to use a gun safely;

whereby the apparatus is operative to maintain the locking member in a locked position and thereby to prevent the gun from firing when the level of competency of said person intending to use the gun is inadequate for safe use of the gun.

7. The apparatus defined in claim 6, wherein said smartphone further includes a data transmitter for transmitting said first signal and wherein said apparatus further comprises a data receiver located on the gun for receiving said first signal from said smartphone.

8. The apparatus defined in claim 7, further comprising:

(5) a second logic device, coupled to said electromechanical actuator and to said data receiver, for receiving gun control signals from said smartphone and transmitting lock and unlock signals to said actuator in response thereto;

(6) a data memory coupled to said second logic device for storing gun unlock data representing first personal information about a person authorized to use the gun; and (7) a gun key device for unlocking the gun, said gun key device including said smartphone and comprising:

(a) a data transmitter for transmitting gun control signals to said data receiver;

(b) a first input device for inputting second personal information about a putative authorized person who wishes to unlock the gun; and (c) said first logic device, coupled to each of said data transmitter, said input device and said testing device, including a phone app with instructions for generating said gun control signals from said second personal information and from said first signal for transmission to said data receiver;

wherein said first logic device is operative to cause said gun lock device to enable the gun to be fired when the second personal information received by said data receiver are substantially the same as the first personal information stored in said data memory and to cause said gun lock device to prevent the gun from being fired when the level of competency of the putative authorized person is inadequate for safe use of the gun.

9. The apparatus defined in claim 8, wherein said second gun unlock data stored in said data memory represent biologic identifying information of a person authorized to use the gun.

10. The apparatus defined in claim 9, wherein said biologic identifying information includes a bodily aspect of said authorized person, selected from the group consisting of:

a facial image;

an image of an iris;

a retinal image;

a fingerprint;

a palm print; and an image of veins of a hand; and wherein said second logic device is operative to process said image and to generate said gun unlock data therefrom.

11. The apparatus recited in claim 6, wherein said logic device maintains said second signal for a prescribed period of time after the person's level of competency has fallen below said prescribed level.

12. Apparatus for alerting authorities under certain circumstances that a person intending to use a gun is a safety risk, said apparatus comprising, in combination:

(1) an electronic testing device for determining an emotional state of a person intending to use a gun and producing a signal indicative that the level of competency of the person is below a prescribed level considered adequate for a safe and proper use of a gun; and (2) an electronic warning device, coupled to said testing device, for alerting the authorities that the person intending to use a gun is at risk of using a gun in an unsafe manner;

wherein said testing device comprises a smartphone, in use by said person intending to use a gun, said smartphone comprising an app for monitoring communications sent from said smartphone and for interpreting said communications to thereby determine the level of competency of said person to use a gun safely;

whereby the apparatus is operative to alert the authorities, who can act to prevent said person from firing a gun, when the level of competency of said person is considered inadequate for a safe and proper use of a gun.

13. Apparatus for alerting authorities under certain circumstances that a person intending to use a gun is a safety risk, said apparatus comprising, in combination:

(1) an electronic testing device for determining an emotional state of a person intending to use a gun and producing a signal indicative that the level of competency of the person is below a prescribed level considered adequate for a safe and proper use of a gun; and (2) an electronic warning device, coupled to said testing device, for alerting the authorities that the person intending to use a gun is at risk of using a gun in an unsafe manner;

wherein said testing device comprises a smartphone, in use by said person intending to use a gun, said smartphone having an app for monitoring social media of said person intending to use a gun and for interpreting entries in said social media made by said person to thereby determine the level of competency of said person to use a gun safely;

whereby the apparatus is operative to alert the authorities, who can act to prevent said person from firing a gun, when the level of competency of said person is considered inadequate for a safe and proper use of a gun.

14. Apparatus for preventing a gun from firing under certain circumstances, said apparatus comprising, in combination:

(1) an electronic testing device for determining a level of a person's competency to use a gun, said testing device producing a signal indicative that the level of competency of the person is below a prescribed level considered adequate for the proper use of the gun;

(2) a locking member associated with a gun and movable between a locked position which prevents the gun from firing and an unlocked position which enables the gun to be fired; and (3) an electromechanical actuator, mechanically coupled to the locking member and electronically coupled to said testing device, for at least one of (1) moving said member from the unlocked position to the locked position and (2) holding said member in the locked position in response to the signal when the level of competency of the person is below said prescribed level;

wherein said testing device comprises a smartphone, in use by said person intending to use a gun, said smartphone comprising an app for monitoring communications sent from said smartphone and for interpreting said communications to thereby determine the level of competency of said person to use a gun safely;

whereby the apparatus is operative to maintain the locking member in a locked position, and thereby to prevent the gun from firing, when the level of competency of a person intending to use the gun is inadequate for a safe and proper use of the gun.

15. Apparatus for preventing a gun from firing under certain circumstances, said apparatus comprising, in combination:

(1) an electronic testing device for determining a level of a person's competency to use a gun, said testing device producing a signal indicative that the level of competency of the person is below a prescribed level considered adequate for the proper use of the gun;

(2) a locking member associated with a gun and movable between a locked position which prevents the gun from firing and an unlocked position which enables the gun to be fired; and (3) an electromechanical actuator, mechanically coupled to the locking member and electronically coupled to said testing device, for at least one of (1) moving said member from the unlocked position to the locked position and (2) holding said member in the locked position in response to the signal when the level of competency of the person is below said prescribed level;

wherein said testing device comprises a smartphone, in use by said person intending to use a gun, said smartphone having an app for monitoring social media of said person intending to use a gun and for interpreting entries in said social media made by said person to thereby determine the level of competency of said person to use a gun safely;

whereby the apparatus is operative to maintain the locking member in a locked position, and thereby to prevent the gun from firing, when the level of competency of a person intending to use the gun is inadequate for a safe and proper use of the gun.

* * * * *